United States Patent [19]

Rodal et al.

[11] Patent Number: 4,617,091

[45] Date of Patent: Oct. 14, 1986

[54] HEADBOX TRAILING ELEMENT

[75] Inventors: José J. A. Rodal, Rockton, Ill.; James L. Ewald, Beloit, Wis.

[73] Assignee: Beloit Corporation, Beloit, Wis.

[21] Appl. No.: 774,862

[22] Filed: Sep. 11, 1985

Related U.S. Application Data

[63] Continuation of Ser. No. 555,158, Nov. 25, 1983, abandoned.

[51] Int. Cl.[4] ..... D21F 1/06; D21F 1/02

[52] U.S. Cl. ..... 162/343; 162/336; 162/344

[58] Field of Search ..... 162/343, 336, 341, 344, 162/347; 428/113, 902

[56] References Cited

U.S. PATENT DOCUMENTS

| | | | |
|---|---|---|---|
| Re. 28,269 | 12/1974 | Hill et al. | 162/343 |
| 3,843,470 | 10/1974 | Betley et al. | 162/336 |
| 4,051,289 | 9/1977 | Adamson | 428/113 |
| 4,173,670 | 11/1979 | Van Auken | 428/111 |
| 4,566,945 | 1/1986 | Ewald et al. | 162/343 |

*Primary Examiner*—S. Leon Bashore
*Assistant Examiner*—K. M. Hastings
*Attorney, Agent, or Firm*—Hill, Van Santen, Steadman & Simpson

[57] ABSTRACT

A headbox for delivering stock to a forming surface in a papermaking machine with the headbox having a slice chamber and a slice opening and having trailing elements positioned in the slice chamber extending transversely of the headbox with means anchoring the elements only at their upstream ends with the downstream portion unattached and constructed to be self-positionable so as to be solely responsive to forces exerted thereon by the stock flowing toward the slice with the elements having greater structural stiffness in the cross-machine direction so that the elements offer resistance to deflection in a cross-machine direction by transient pressure variations and offer minimal resistance to deformation of the fluid flow stream for balancing forces on opposite sides of the elements with the elements in one form being laminated with a plurality of anisotropic layers.

23 Claims, 4 Drawing Figures

HEADBOX TRAILING ELEMENT

This is a continuation of application Ser. No. 555,158, filed 11/25/83, now abandoned.

BACKGROUND OF THE INVENTION

The invention relates to improvements in paper machine headboxes, and more particularly to improvements in the slice chamber of headboxes wherein trailing elements extend freely toward the slice opening for maintaining fine scale turbulence in the stock at the slice opening.

The concept of providing a freely movable self-positionable trailing element in the slice chamber of a headbox was first disclosed in U.S. Pat. No. 3,939,037, Hill. In U.S. Pat. No. Re. 28,269, Hill et al, trailing elements are disclosed extending pondside to pondside. These trailing elements are capable of generating or maintaining fine scale turbulence in the paper stock flowing toward and through the slice opening. The concepts of the foregoing patents may also be employed to utilize their advantage and to function in a machine for making multi-ply paper wherein stocks of different characteristics are fed to chambers on opposite sides of the trailing elements where the elements extend pondside to pondside.

A basic limitation in headbox design has been that the means for generating turbulence in fiber suspension in order to disperse the fibers have been only comparatively large-scale devices. With such devices, it is possible to develop small scale turbulence by increasing the intensity of turbulence generated. Thus, the turbulence energy is transferred naturally from large to small scales and the higher the intensity, the greater the rate of energy transfer and hence, the smaller the scales of turbulence sustained. However, a detrimental effect also ensued from this high intensity large-scale turbulence, namely, the large waves and free surface disturbance developed on the Fourdrinier table. Thus, a general rule of headbox performance has been that the degree of dispersion and level of turbulence in the headbox discharge was closely correlated; the higher the turbulence, the better the dispersion.

In selecting a headbox design under this limiting condition then, one could choose at the extreme, either a design that produces a highly turbulent, well-dispersed discharge, or one that produces a low-turbulent, poorly dispersed discharge. Since either a very high level of turbulence or a very low level (and consequent poor dispersion) produces defects in sheet formation on the Fourdrinier machine, the art of the headbox design has consisted of making a suitable compromise between these two extremes. That is, a primary objective of the headbox design up to that time had been to generate a level of turbulence which was high enough for dispersion, but low enough to avoid free surface defects during the formation period. It will be appreciated that the best compromise would be different for different types of papermaking furnishes, consistencies, Fourdrinier table design, machine design, machine speed etc. Furthermore, because these compromises always sacrifice the best possible dispersion and/or the best possible flow pattern on the Fourdrinier wire, it is deemed that there is a great potential for improvement in headbox design today.

The unique and novel combination of elements of the aforementioned patents provide for delivery of the stock slurry to a forming surface of a papermaking machine having a high degree of fiber dispersion with a low level of turbulence in the discharge jet. Under these conditions, a fine scale dispersion of the fibers is produced which will not deteriorate to the extent that occures in the turbulence dispersion which are produced by conventional headbox designs. It has been found that is the absence of large-scale turbulence which precludes the gross reflocculation of the fibers since flocculation is predominately a consequence of small scale turbulence decay and the persistence of the large scales. Sustaining the dispersion in the flow on the Fourdrinier wire then, leads directly to improved formation.

The method by which the above is accomplished, that is, to produce fine scale turbulence without large scale eddies, is to pass the fiber suspension through a system of parallel cross machine channels of uniform small size but large in percentage open area. Both of these conditions, uniform small channel size and large exit percentage open area, are necessary. Thus, the largest scales of turbulence developed in the channel flow have the same order of size as the depth of the individual channels by maintaining the individual channel depth small, the resulting scale of turbulence will be small. It is necessary to have a large exit percentage open area to prevent the development of large scales of turbulence in the zone of discharge. That is, large solid areas between the channel's exits, would result in large-scale turbulence in the wake of these areas.

In concept then, the flow channel must change from a large entrance to a small exit size. This change should occur over a sustantial distance to allow time for the large-scale coarse flow disturbances generated in the wake of the entrance structure to be degraded to the small-scale turbulence desired. The area between channels approaches the small dimension that it must have at the exit end. This concept of simultaneous convergence is an important concept of design of this invention.

Under certain operating conditions, the trailing members which are employed to obtain the fine scale turbulence are not necessarily stable. Cross-machine transient pressures tend to bend the trailing element in the cross-machine direction and cause cross-machine uniformity variances in the paper. Resistance to deformation along the machine direction length of the trailing elements can cause slight digressioins in the uniform velocity of the stock flowing off the surfaces at the trailing edge of the trailing element. Static or dynamic instability can occur at certain operating conditions and resonant frequencies can be reached dependent on the hydrodynamic forces. It has been discovered that the inertia and hydrodynamic couplings can be broken by suitable distribution of the mass and elasticity of the trailing structure with proper mass distribution and stiffness distribution being of importance.

It is accordingly an object of the invention to provide an improved trailing element design which avoids disadvantages that occur at certain operating conditions in structures heretofore available, and particularly a trailing element which offers resistance to a deflection in the cross-machine direction and which offers minimal resistance to deformation in the fluid flow stream so that pressures are balanced on opposite sides of the trailing edge of the trailing elements.

Definition of Terms:

machine direction: Flow direction.

isotropic: Having the same properties in *all* directions.

anisotropic: Not isotropic, that is exhibiting different properties when tested along axes in different directions.

In accordance with the principles of the invention, the objectives are attained by providing a trailing element which has a greater structural stiffness (preferably at the downstream tip) in the cross-machine direction than in the machine direction, and in a preferred form which is made of an anisotropic material, preferably on being formed of a laminate with separate layers of the laminate providing the qualities of cross-machine stiffness and machine direction strength and flexibility by either material properties, direction, size or number. Alternates of woven or needled material with weave directions or materials, or size or numbers of filaments controlling directional stiffness may be used.

By utilizing an anisotropic material, design factors which are otherwise not alway available can be included such as strength, stiffness, corrosion resistance, wear resistance, weight, fatigue life, thermal expansion or contraction, thermal insulation, thermal conductivity, acoustical insulation, damping of vibrations, buckling, low friction and optimal design in manufacture.

Other objects, advantages and features will become more apparent with the teaching of the principles of the invention in connection with the disclosure of the preferred embodiment in the specification, claims and drawings, in which:

DESCRIPTION OF THE PREFERRED EMBODIMENTS

Figure 1A:
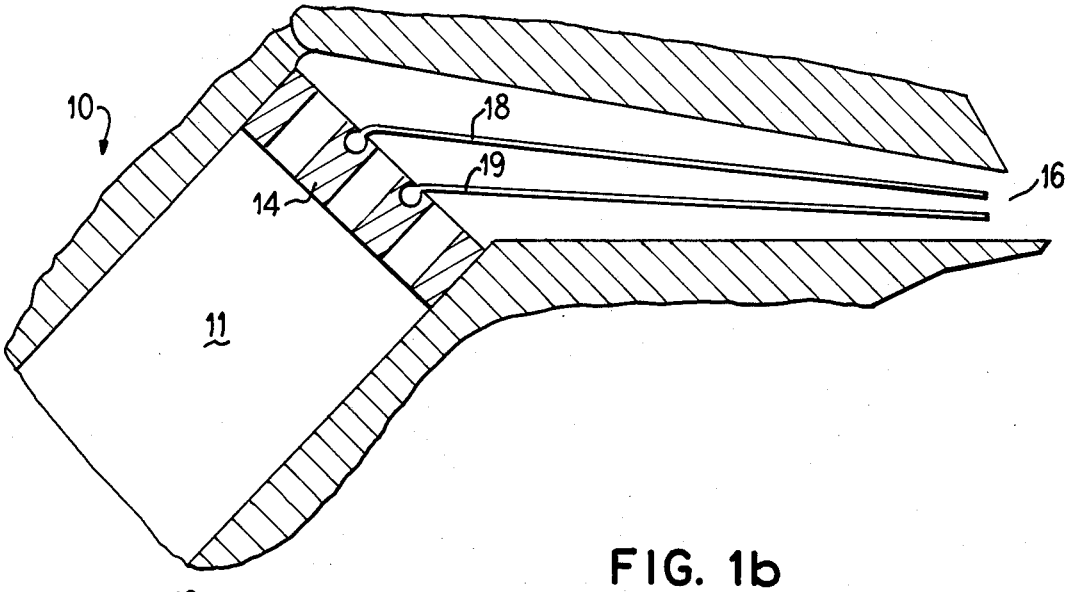
FIGS. 1A, 1B and 1C are side elevational views in section, shown somewhat schematic of a paper machine headbox embodying the principles of the present invention.

As illustrated in FIG. 1, a headbox 10 has papermaking stock 11 delivered thereto to flow through the headbox toward a slice chamber. In a headbox, various arrangements are positioned upstream of the slice chamber to control the flow and turbulence of the stock. The stock flows forwardly through openings in a wall 14 at the entry to the slice chamber. Trailing elements 18 and 19, FIG. 1A, extend downstream in the slice chamber pivoted at their upper ends and free along their lengths and at their lower ends to be positionable solely due to forces of the stock flowing toward the slice opening 16. As the stock is emitted from the slice opening 16, it is delivered onto a traveling forming surface. The trailing elements are pivotally mounted at their upstream ends, and the pivotal mounting is immediately followed by a bent or angular portion which permits a short portion of the trailing elements to extend at right angles to the wall 14 and because of the bend, the trailing elements immediately turn and extend in the direction of the slice chamber.

Figure 1B:
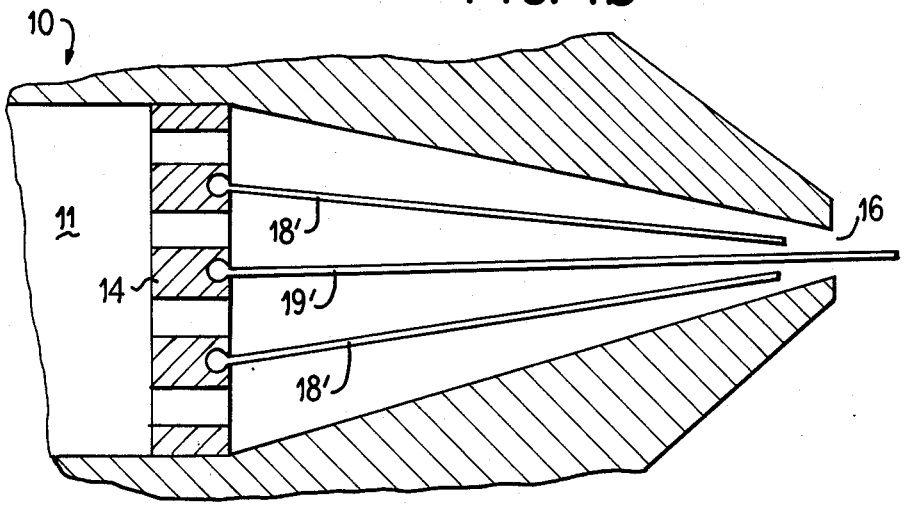

In FIG. 1B, two outer trailing elements 18' extend substantially the length of the slice chamber, and an intermediate trailing element 19' is constructed of greater length to extend through and slightly beyond the slice opening 16.

Figure 1C:
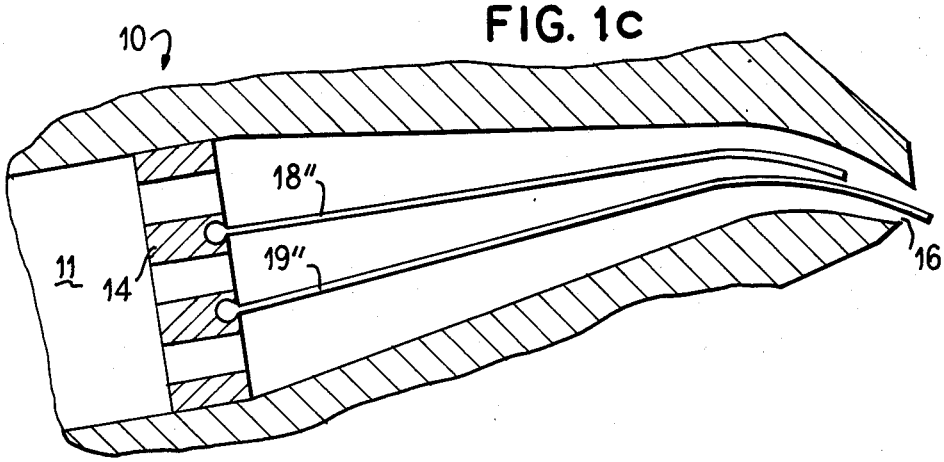

In the arrangement of FIG. 1C, the downstream ends of the trailing elements 18'' and 19'' are curved to substantially conform to the curvature of the slice chamber as shown in FIG. 1C. The upper trailing element 18' terminates short of the slice opening 16, whereas the lower trailing element 19'' extends beyond the slice opening a short distance.

Figure 2:
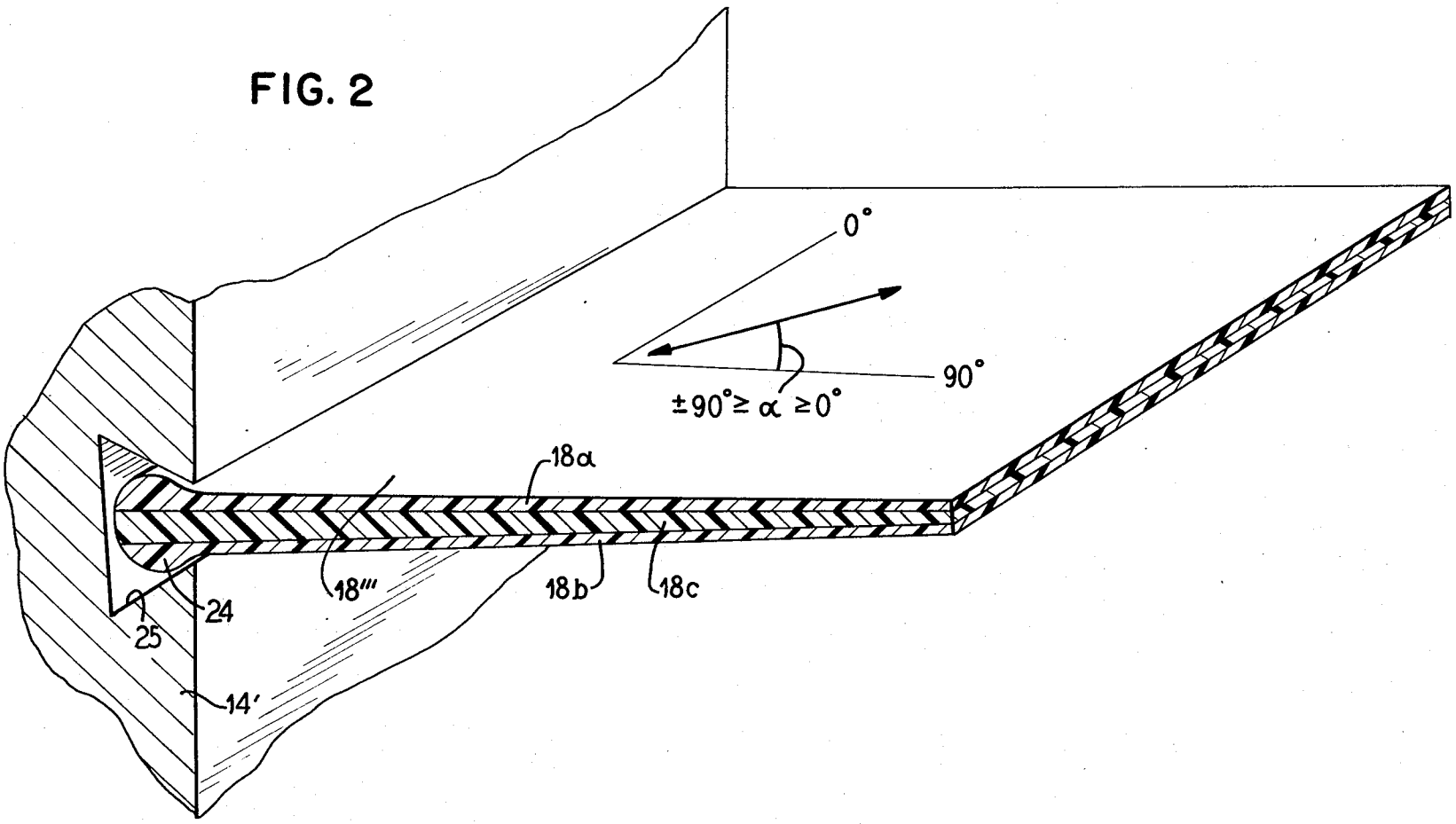
FIG. 2 is a perspective view partially in section of a trailing element of the headbox of FIG. 1.

In FIG. 2, a form of trailing element 18''' is shown in detail. The trailing element 18''' has outer layers **18*a* and 18*b* and a central integrally sandwiched intermediate layer 18*c* therebetween. The upper end of the trailing element is pivotally supported in a wall 14' such as by an enlarged or bulbous ridge 24 at the upper end pivotally mounted in a slot 25 in the wall 14'**. Directional lines are shown with a machine direction line shown at the 90° axis and the cross-machine direction shown at the 0° axis and the intermediate direction shown by the double arrowed line with the angle between the double arrowed line and the machine direction line shown as $\alpha$.

Various forms of headboxes may be employed as will be recognized by those versed in the art, including such as shown schematically in the aforementioned patents, U.S. Pat. No. Re. 28,269 and U.S. Pat. No. 3,939,037.

In structures heretofore available, the trailing elements were formed of metal or plastic or woven and were isotropic in nature in the sense that the trailing element stiffness (Young's modulus) was the same in the flow and cross-flow direction. In accordance with the present invention, the trailing elements which extend flat in a cross-flow direction either in separate strips or continuous from pondside to pondside, can be a single layer or multilayered, flat or curved, (in the flow direction) uniform thickness, or tapered, thin or thick. The material is anisotropic so as to have different strength and/or stiffness characteristics in different directions. In a preferred form, the anisotropic trailing elements have a greater stiffness in the cross-machine direction than in the machine direction. This being more important at the downstream tip of the trailing element.

By increasing the stiffness in the cross direction, deformations due to pressure variations are reduced or eliminated. By having the trailing element flexible in the machine direction, effects or pressure differences upstream on the trailing element have a minimum effect on the position of the downstream edge of the trailing element so that it functions to maintain the velocities equal of the layers emerging off of the edge to minimize shear between the layers.

In a preferred arrangement, the difference between the stiffness in a cross-machine direction and a machine direction is a minimum of 5% and preferred to be 500% or more. Presently, the stiffness limit as designated by Young's modules in the cross-machine direction is a maximum 100,000,000 psi, and a minimum stiffness in the machine direction is 50,000 psi, due to existing materials properties.

The anisotropic trailing elements can be formed of a composite material, that is, a laminate wherein the different physical properties of the different layers can be taken advantage of. For example, if a three layered trailing element is provided, the outer layers can be formed with cross-direction fibers of a material such as graphite, with the inner layer containing a weaker stiffness material oriented in the machine direction, such as fiberglass. This would give greater stiffness in the cross direction, and less stiffness in the machine direction due to material stiffness, and material position within the matrix. The anisotropic trailing elements can be formed from composite materials such as graphite, kevlar, boron, glass, carbon, beryllium, steel, titanium, or aluminum fibers in matrices such as epoxy, polyamide, carbon, polyester, phenolic, silicone, alkyd, melamine, fluorocarbon, polycarbonate, acrylic, acetal, polypropylene, ABS copolymer, polyuphone, polyethylene, PEEK, polystyrene, PPS, nylon, thermoset, plastics, thermoplastics, glass, metal or other matrices. Different materials can be combined, not such as in alloying where the result is homogeneous, and isotropic. The advantage of a composite laminate is that it may attain the best qualities of the constituents and often qualities that neither alone possess. Tailoring of an anisotropic material yields not only the stiffness, strength, thermal expansion, thermal conductivity, acoustic insulation, fatigue and life required in a given direction, but functions in an improved manner during service of the headbox. The relative factors sought after are: strength, stiffness, thermal expansion, thermal conductivity and so forth. If an isotropic material were used, a compromise would have to be reached as to the material chosen. This compromise is not necessary in an anisotropic structure, wherein the desirable properties of different directions may be exploited. Outstanding mechanical properties can be combined with unique flexibility. Properties that can be improved by using an anisotropic design are strength, stiffness, corrosion resistance, wear resistance, weight, fatigue, life, thermal expansion or contraction, thermal insulation, thermal conductivity, acoustical insulation, damping of vibrations, buckling, low friction and optimum design and manufacture.

By design the inertia and hydrodynamic couplings can be broken by suitable distribution of the mass and elasticity of the structure with proper mass and stiffness distribution being of significant importance. An anisotropic design can attain stability with improved function of the trailing elements.

While the structure is shown with the trailing elements being pivotally mounted at their upstream end, this is a preferred arrangement and other forms of mounting may be employed which need not be pivotal. It is important, however, that the trailing element be self-positionable so that the position is controlled by the pressure of the stock flowing on opposite sides of the trailing element. The element is preferably free of attachment at the pondsides, but can be attached at the pondsides in some structures where movement due to hydraulic forces is small. While a trailing element formed of a single material may be used, a laminate may be employed such as illustrated in Figure 2 wherein different physical properties of different layers can be taken advantage of. Various thicknesses of the trailing edge of the elements may be employed, but 10 to 120 mils is a thickness that has been found to be satisfactory.

While the foregoing has described the construction of the entire element, the element may be contructed so that at least a portion thereof has a structural stiffness in the cross-machine direction greater than in the machine direction. In one form the element may be constructed so that the downstream portion of said element has a greater structural stiffness in the cross-machine direction than in the machine direction. In all embodiments, as shown in the drawings, the trailing elements have planar stock-contacting surfaces on opposite sides which extend continuously from side-to-side and from an upstream end to a downstream end of the element so as to present a substantially uninterrupted flat surface to the stock flow.

Thus, it will be seen that we have provided an improved headbox design which meets with the objectives and advantages above set forth and avoids problems existent under certain operating conditions heretofore present in the art.

We claim as our invention:

1. In a headbox for delivering stock to a forming surface, the headbox having a slice chamber and a slice opening, the improvement compsrising:

a trailing element having planar stock-contacting surfaces extending continuously from side-to-side and from an upstream and to a downstream end of the element, said element positioned in the slice chamber for stock flow induced movement;

said element extending transversely of said headbox and consisting of material giving said element greater structural stiffness in the cross-machine direction than in the machine direction so that the element resists deflection in the cross-machine direction by transient pressure variations and offers low resistance to deformation in the fluid flow stream for balancing pressure forces on opposite sides of the element; and means anchoring said elements in the slice chamber at an upstream portion with the downstream portion unattached and constructed to be self-positionable so as to be responsive to forces exerted thereon by the stock flowing over the surface of the element.

2. In a headbox for delivering stock to a forming surface, the headbox having a slice chamber and a slice opening and constructed in accordance with claim 1:

wherein the element has a cross-machine Young's modulus maximum stiffness of substantially 100,000,000 psi and a machine direction Young's modulus stiffness of a minimum of substantially 50,000 psi.

3. In a headbox for delivering stock to a forming surface, the headbox having a slice chamber and a slice opening and constructed in accordance with claim 1:

wherein the element is constructed in layers of a graphite epoxy extending unidirectionally.

4. In a headbox for delivering stock to a forming surface, the headbox having a slice chamber and a slice opening, the improvement comprising:

the structure set forth in claim 1 wherein a plurality of trailing elements of substantially similar construction is included having the structure of the trailing element defined in claim 1.

5. In a headbox for delivering stock to a forming surface, the headbox having a slice chamber and a slice opening, the improvement comprising:

a trailing element positioned in the slice chamber for stock flow induced movement, said element extending transversely of said headbox, said element having planar stock-contacting surfaces extending continuously from side-to-side and from an upstream end to a downstream end of the element, said element being formed of multiple layers laminated to each other along their confronting surfaces with one of said layers having a structural stiffness in the cross-machine direction greater than in the machine direction so that said element has a structural stiffness in the cross-machine direction greater than in the machine direction; and means anchoring said element at an upstream end with a downstream portion unattached and constructed to be self-positionable so as to be solely responsive to forces exerted thereon by stock flowing over the surfaces of the element.

6. In a headbox for delivering stock to a forming surface, the headbox having a slice chamber and a slice opening and constructed in accordance with claim 5:

wherein said element has an intermediate layer and outer layers with one of the intermediate layers having a structural stiffness in the cross-machine direction greater than in the machine direction and the outer layers having a smooth outer surface facing the stock flow stream.

7. In a headbox for delivering stock to a forming surface, the headbox having a slice chamber and a slice opening, and constructed in accordance with claim 5:

wherein the trailing edge of the element has a thickness in the range of 10 to 120 mils.

8. In a headbox for delivering stock to a forming surface, the headbox having a slice chamber and a slice opening, the improvement comprising:

a trailing element having planer stock-contacting surfaces extending continuously from side-to-side and from an upstream and to a downstream end of the element, said element positioned in the slice chamber extending transversely of said headbox from pondside to pondside, said element consisting of material giving said element greater structural stiffness in the cross-machine direction than in the machine direction so that the element offers resistance to deflection in the cross-machine direction by transient pressure variations and offers minimum resistance to deformation in the fluid flow stream for balancing pressure forces on opposite sides of the element; and means anchoring said element in the slice chamber at an upstream portion with a downstream portion unattached and constructed to be self-positionable so as to be solely responsive to forces exerted thereon by the stock flowing over the surfaces of the element.

9. In a headbox for delivering stock to a forming surface, the headbox having a slice chamber and a slice opening and constructed in accordance with claim 8:

werein the element is formed in layers with one of the layers having a structural stiffness in the cross-machine direction greater than in the machine direction and another of the layers having uniform stiffness in each direction.

10. In a headbox for delivering stock to a forming surface, the headbox having a slice chamber and a slice opening and constructed in accordance with claim 9:

wherein the element has outer layers and an intermediate layer and the intermediate layer has structural stiffness in the cross-machine direction greater than in the machine direction.

11. In a headbox for delivering stock to a forming surface, the headbox having a slice chamber and a slice opening and constructed in accordance with claim 9:

wherein the element has outer layers and an intermediate layer with at least one of the outer layers having a stuructural stiffness in the cross-machine direction greater than in the machine direction.

12. In a headbox for delivering stock to a forming surface, the headbox having a slice chamber and a slice opening, the improvement comprising:

a trailing element positoned in the slice chamber, said element extending transversely of said headbox from pondside to pondside, said element having planar stock-contacting surfaces extending continuously from side-to-side and from an upstream end to a downstream end of the element, said element formed of a plurality of laminated layers with one of said layers being an anisotropic material selected from the group of graphite, kevlar, boron, glass, carbon, beryllium, steel, titanium, or aluminum fibers in matrices chosen from the group of epoxy, polyamide, carbon, polyester, phenolic, silicone, alkyd, melamine, fluorocarbon, polycarbonate, acrylic, acetal, polypropylene, ABS copolymer, polyethylene, polysulfone, polystyrene, nylon, glass, or metal, the overall stiffness of said element in the cross-machine direction being greater than in the machine direction.

13. In a headbox for delivering stock to a forming surfce, the headbox having a slice chamber and a slice opening, and a trailing element positioned in the slice chamber with the element extending transversely of said headbox and anchored at an upper portion within the slice chamnber with a lower downstream portion being unattached and self-positionable so as to be responsive to forces of the stock on opposite surfaces of the element, the improvement comprising:

the element having planar stock-contacting surfaces extending continuously from side-to-side and from an upstream end to a downstream end of said element, and consisting of material giving at least a portion of said element greater structural stiffness in the cross-machine direction than in the machine direction.

14. In a headbox constructed in accordance with claim 13:

wherein said portion is formed of a anisotropic material selected from the group of graphite, kevlar, boron, glass, carbon, beryllium, steel, titanium or aluminum fibers in matrices chosen from the group of epoxy, polyamide, carbon, polyester, phenolic, silicone, alkyd, melamine, fluorocarbon, polycarbonate, acrylic, acetal, polypropylene, ABS copolymer, polyethylene, polysulfone, polystyrene, nylon, glass or metal.

15. In a headbox for delivering stock to a forming surface, the headbox having a slice chamber and a slice opening, the improvement comprising:

a trailing element positioned in the slice chamber for stock flow induced movement, said element having planar stock-contacting surfaces extending continuously from side-to-side and from an upstream end to a downstream end of said element, and said element extending transversely of said headbox and anchored at its upstream end with the downstream portion unattached and constructed to be self-positionable to be responsive to forces exerted thereon by stock flowing over the surfaces of the trailing element; and said element consisting of material giving the downstream portion of said element greater structural stiffness in the cross-machine direction than in the machine direction.

16. In a headbox for delivering stock to a forming surface, the headbox having a slice chamber and a slice opening and constructed in accordance with claim 5 wherein:

a plurality of trailing elements are provided in the slice chamber of substantially similar construction.

17. In a headbox for delivering stock to a forming surface, the headbox having a slice chamber and a slice opening and constructed in accordance with claim 8 wherein:

a plurality of trailing elements are provided in the slice chamber of substantially similar construction.

18. In a headbox for delivering stock to a forming surface, the headbox having a slice chamber and a slice opening, the improvement comprising:

a trailing element positioined in the slice chamber and extending transversely of said headbox from pondside to pondside, said element having planar stock-contacting surfaces extending continuously from side-to-side and from an upstream end to a downstream end of the element, said element being formed of a plurality of laminated layers, one of said layers having an anisotropic material comprising high-strength fibers embedded in a synthetic resin matrix, the overall stiffness of said element in the cross-machine direction being greater than in the machine direction.

19. A headbox according to claim 18 wherein said synthetic resin matrix is a thermoplastic resin.

20. A headbox according to claim 18 wherein said synthetic resin matrix is a thermosetting resin.

21. In a headbox for delivering stock to a forming surface, the headbox having a slice chamber and a slice opening, and a trailing element positioned in the slice chamber with the element extending transversely of said headbox and anchored at an upper portion within the slice chamber with a lower downstream portion being unattached and self-positionable so as to be responsive to forces of the stock on opposite surfaces of the element, the improvement comprising:

a trailing element positioned in the slice chamber and extending transversely of said headbox from pondside to pondside, said element having planer stock-contacting surfaces extending continuously from side-to-side and from an upstream end to a downstream end of the element, said element being formed of a plurality of laminated layers, one of said layers being an anisotropic material comprising high-strength fibers embedded in a synthetic resin matrix, the overall stiffness of said element in the cross-machine direction being greater than in the machine direction.

22. The headbox of claim 21 wherein said synthetic resin matrix is a thermoplastic resin.

23. A headbox according to claim 21 wherein said synthetic resin is a thermosetting resin.

* * * * *